United States Patent [19]

Hattori et al.

[11] Patent Number: 4,568,252

[45] Date of Patent: Feb. 4, 1986

[54] SWASH-PLATE TYPE COMPRESSOR

[75] Inventors: Mitsuhiro Hattori; Hiromitsu Ohno; Kenji Takenaka; Shigeaki Takahashi, all of Kariya, Japan

[73] Assignees: Kabushiki Kaisha Toyoda Jidoshokki Seisakusho; Taiho Kogyo Co., Ltd., both of Aichi, Japan

[21] Appl. No.: 736,397

[22] Filed: May 17, 1985

Related U.S. Application Data

[63] Continuation of Ser. No. 238,084, Feb. 25, 1981, abandoned.

[30] Foreign Application Priority Data

| | | | |
|---|---|---|---|
| Mar. 7, 1980 | [JP] | Japan | 55-29667 |
| Sep. 9, 1980 | [JP] | Japan | 55-125032 |
| Sep. 10, 1980 | [JP] | Japan | 55-125737 |
| Sep. 11, 1980 | [JP] | Japan | 55-126432 |

[51] Int. Cl.[4] ..... F04B 1/16; F04B 1/14

[52] U.S. Cl. ..... 417/269; 92/71

[58] Field of Search ..... 417/269; 91/499; 92/58, 92/71

[56] References Cited

U.S. PATENT DOCUMENTS

| | | | |
|---|---|---|---|
| 2,357,563 | 9/1944 | Truxell, Jr. | 417/269 |
| 3,933,082 | 1/1976 | Molly | 91/499 |
| 4,037,522 | 7/1977 | Inoshita | 92/71 |
| 4,244,679 | 1/1981 | Nakayama et al. | 92/71 |
| 4,268,225 | 5/1981 | Nakayama et al. | 417/269 |
| 4,285,640 | 8/1981 | Mukai | 417/269 |
| 4,307,998 | 12/1981 | Nakayama et al. | 417/269 |
| 4,329,913 | 5/1982 | Nakayama et al. | 417/269 |
| 4,420,986 | 12/1983 | Nakayama | 417/269 |

FOREIGN PATENT DOCUMENTS

| | | | |
|---|---|---|---|
| 47901 | 1/1979 | Japan | 417/269 |
| 47902 | 2/1979 | Japan | 417/269 |
| 47903 | 3/1979 | Japan | 417/269 |
| 47912 | 12/1979 | Japan | 417/269 |
| 638758 | 6/1950 | United Kingdom | 92/58 |

OTHER PUBLICATIONS

The Review of Scientific Instruments vol. 43, No. 9, pp. 1331–1333, Sep. 1972.

*Primary Examiner*—William L. Freeh

*Attorney, Agent, or Firm*—Burgess, Ryan & Wayne

[57] ABSTRACT

A swash-plate type compressor having a housing, a drive shaft rotatably supported by the housing, a swash-plate slantly secured on the drive shaft, and a plurality of pistons fitted in a cylinder bore formed in correspondence to each of the pistons parallelly to the drive shaft and provided with a pair of concave spherical surface formed therein. Each of the pistons is engaged with the swash-plate via a pair of shoes of substantially semi-spherical shape. The shoe has a convex spherical surface which is in sliding contact with the concave spherical surface of the piston and a flat-side surface which is in sliding contact with the swash-plate. The flat-side surface consists of a chamfered surface annularly formed on the outer portion thereof and a centrally left substantially flat surface with a diameter as large as about 60–90% of that of the whole flat-side surface. The substantially flat surface is formed into an extremely gentle convex surface with a height less than 15 μm at the peak located in the center thereof. The whole surface of the shoe is covered by a solid lubricating film.

12 Claims, 21 Drawing Figures

SWASH-PLATE TYPE COMPRESSOR

This application is a continuation of application Ser. No. 238,084, filed Feb. 25, 1981, now abandoned.

FIELD AND BACKGROUND OF THE INVENTION

This invention relates to a swash-plate type compressor, and more particularly, to an improvement of a bearing device disposed between the swash-plate and the piston.

A swash-plate type compressor here signifies a compressor wherein a swash-plate secured to a rotary drive shaft with a certain angle thereto is being engaged with a piston which is parallelly disposed to the rotary drive shaft, so that the latter is reciprocated owing to the rotation of the former. From such a structure the engaging portion of the swash-plate and the piston must be protected by a bearing device by all means. A technology of employing a shoe of substantially semi-spherical shape is disclosed in the specification of U.S. patent application numbered with Ser. No. 071,616 now abandoned filed by three coinventors out of the four coinventors of this invention. And an idea of employing semi-spherical shoe in a reciprocating engine or pumps of swash-plate type which is rather similar to the compressor is discribed in some literatures such as U.S. Pat. Nos. 2,672,095, 3,938,397, 3,939,717, 4,030,404, etc.

The semi-spherical shoe used as a bearing device functions as a transmitter of drive force from the swash-plate to the piston, while slidably contacting at its convex spherical surface with a concave spherical surface formed in the piston and also slidably contacting at its flat surface with a flat surface on the swash-plate. Employment of such a semi-spherical shoe as a bearing device contributes a great deal to miniaturization, weight lightening, and cost economizing of a compressor, it is true indeed. It turned out, however, from the later study by the co-inventors that this device is still not free from the problem of durability.

A compressor according to the disclosure U.S. Ser. No. 071,616, is mainly used in air conditioning of cars for compressing refrigerant gas therein, and usually driven by the engine for the car driving. The semi-sphere shoe in the compressor is lubricated by oil mist contained in the circulating refrigerant gas. The amount of the oil mist supplied to the required sliding places is liable to decrease, when the engine is in an idle driving state, through remarkable decrease of the rotation number of the compressor accompanied by decreasing of the circulated refrigerant amount. This shortage of the oil mist carried by the circulating refrigerant is liable to make the sliding places of the semi-sphere shoe, particularly the sliding surface with the swash-plate, frictional leading to wear and seizure of the flat-side surface of the shoe, which might some time invite shortening of compressor's life.

SUMMARY OF THE INVENTION

This invention was made from such a background. It is therefore the primary object of this invention to provide a swash-plate type compressor fully durable even under a severe lubrication condition.

Another object of this invention is to provide a swash-plate type compressor wherein seizure between the semi-sphere shoe and the swash-plate is prevented to the highest possible extent.

Still another object of this invention is to provide a compact and light-weight swash-plate type compressor provided with high durability at low cost.

Further object of this invention is to provide a swash-plate type compressor which is excellent in preventing power loss.

For attaining those objects a swash-plate type compressor of this invention possesses a very favorable configuration, on the flat-side surface of the semi-spherical shoe where it is in sliding contact with the swash-plate, for forming a lubricating oil film there. One of the concrete measures adopted therefor is to form an annular chamfered surface on the outer portion of the flat-side surface of the semi-spherical shoe, leaving in the central portion thereof a flat circular portion with a diameter as large as about 60–90% of that of the whole flat-side surface. Another measure is to form the flat-side surface into an extremely gentle convex surface, being unappreciable with naked eye, having a large radius of curvature with a height less than 15 $\mu$m at the peak located in the center of the flat-side surface. Having an annular chamfered surface on the peripheral portion of the gentle convex surface is a more efficient step for attaining the objects of this invention. It is preferable, in this instance, to leave the gentle convex surface portion inside the chamfered surface, i.e., within the border line between the two, with a diameter as large as about 60–90% of that of the whole flat-side surface. The angle of the chamfered surface is preferable to be far smaller than that in ordinary chamfer cases, 45° or 30°, i.e., it is preferred to be less than 15°.

Making the swash-plate from an aluminum-silicon alloy is good for greatly diminishing the weight of the compressor, and it is preferable in this case to keep the hardness of the flat-side surface, by the Rockwell hardness in C scale, greater than 50 ($H_RC$).

As to the lubrication on the sliding surface of the shoe, particularly on the convex spherical surface thereof where it is in sliding contact with the piston, it is recommended to have a film containing solid lubricant for improving the mutual sliding between the shoe and the piston, with a result of decreasing the power loss in a swash-plate type compressor. As the solid lubricant recommendable here are molybdenum disulfide, graphite, polytetrafluoroethylene, boron nitride, tungsten disulfide, etc., or mixtures of those materials, and the film thickness is preferred to be less than 10 $\mu$m.

Other objects and effects of this invention will be understood more clearly from the study of the following description of the embodiments made in conjunction with the accompanying drawing.

DETAILED DESCRIPTION OF THE PREFERRED EMBODIMENTS

Figure 1:
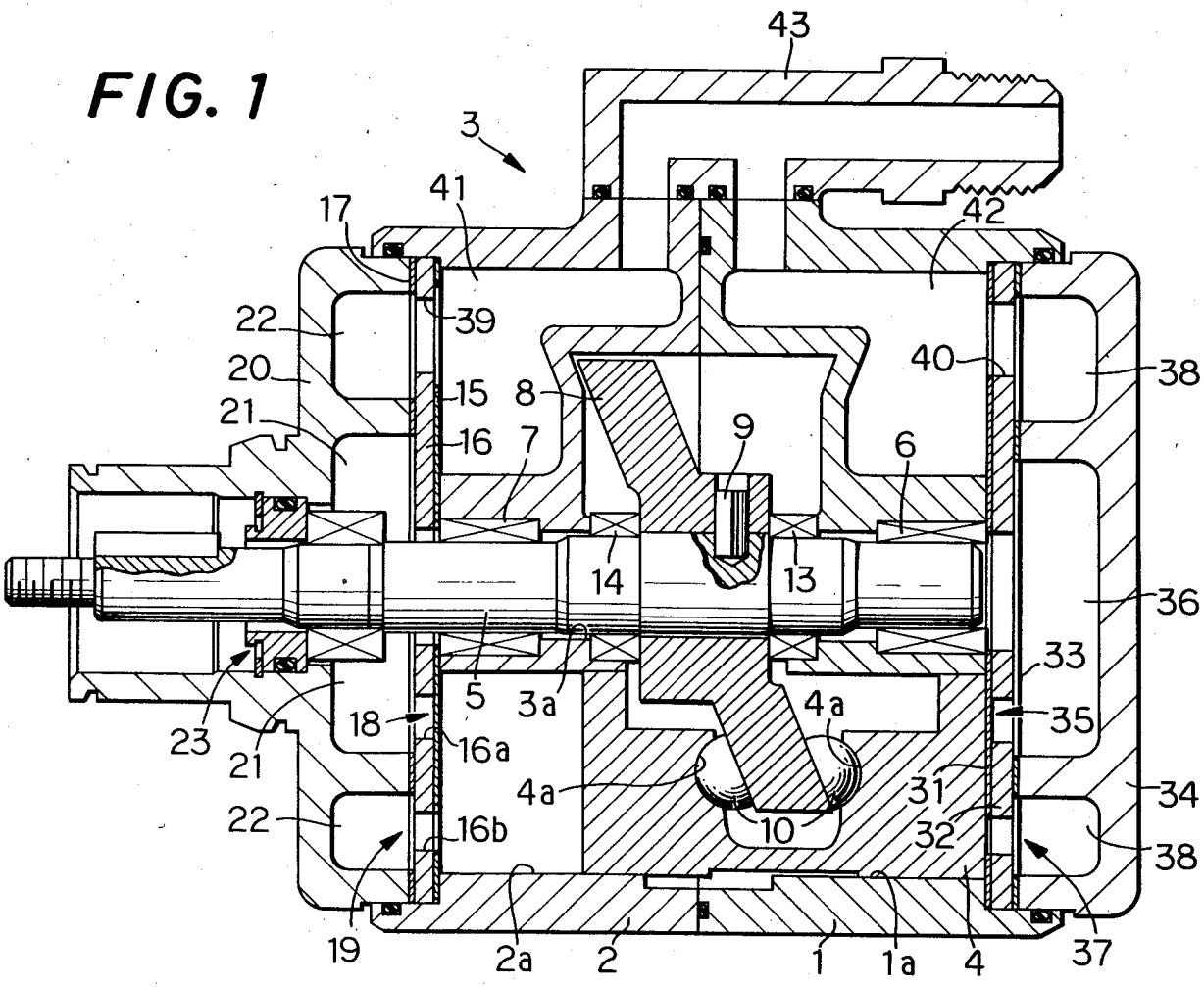
FIG. 1 is an axial section of an embodiment of a compressor in accordance with the invention.

In FIG. 1 which indicates a refrigerant compressor used for a car air conditioning, a main housing 3 is built of a pair of cylinder blocks 1, 2 of symmetrical form, in each of them three (five is also permissible according to the circumstances) cylinder bores 1*a*, 2*a*, are formed parallelly to each other. In those cylinder bores 1*a*, 2*a* an Al-Si alloy made piston 4 with two heads is slidably fitted, one for each cylinder bore. Through a central bore 3*a* formed parallelly to the cylinder bores 1*a*, 2*a* in the main housing 3 a drive shaft 5 is pierced, being rotatably supported by radial bearings 6 and 7. On the middle part of the drive shaft 5 a swash-plate 8 of ductile cast iron or steel is secured with a spring pin 9. When the swash-plate 8 is rotated, each of the pistons 4 is respectively reciprocated in the cylinder bore 1*a*, 2*a* by way of a pair of steel made shoes or sliding bodies 10 of almost semi-spherical shape with a diameter of 13.5 mm. The pair of shoes 10, provided with a convex spherical surface 10*a* and and a flat-side surface 10*b*, are disposed on opposite side of the swash-plate 8 in such a posture that the convex spherical (substantially semi-spherical) surface 10*a* of each shoe 10 is in sliding contact with each of a pair of concave spherical (part-spherical) surfaces 4*a* formed in the piston 4 face to face one another and the flat-side surface 10*b* is respectively in sliding contact with the swash-plate 8. And numerals 13, 14 designate respectively a thrust bearing. On one end of the cylinder block 2 a front housing 20 is secured with a suction valve sheet 15, a valve plate 16, and a gasket 17 sandwiched therebetween. In the valve plate 16 three suction openings 16*a* and three discharge openings 16*b* are formed, which constitute respectively three suction valves 18 and three discharge valves 19 with the aid of a suction valve sheet 15 and a discharge valve read (not shown) respectively. Each suction valve 18 is so located as to be able to suck refrigerant gas from a common suction chamber 21 formed in the front housing 20, and each discharge valve 19 is so located as to be able to discharge the refrigerant gas to a common discharge chamber 22.

The drive shaft 5 is pierced through the central portion of the front housing 20 to project outside for being connected to an engine, a drive power source, via an electromagnetic clutch. The drive shaft 5 and the front housing 20 are gastightly sealed by a shaft seal 23.

On one end of the cylinder block 1 a rear housing 34 is secured with a suction valve sheet 31, a valve plate 32, and a gasket 33 sandwiched therebetween. Each of the cylinder bores 1*a* is connected to a suction chamber 36 via a suction valve 35 and to a discharge chamber 38 via a discharge valve 37. The suction chambers 21 and 36 are communicated to each other through a not-shown suction passage formed piercing through the main housing 3 and also connected to a suction pipe by way of a not-shown common suction flange. And the discharge chambers 22 and 38 are connected to a common discharge flange 43 respectively through a hole 39, 40 formed through the valve plate 16 and the valve plate 32, and a discharge passage 41, 42 formed through each of the cylinder blocks 2, 1.

Figure 2:
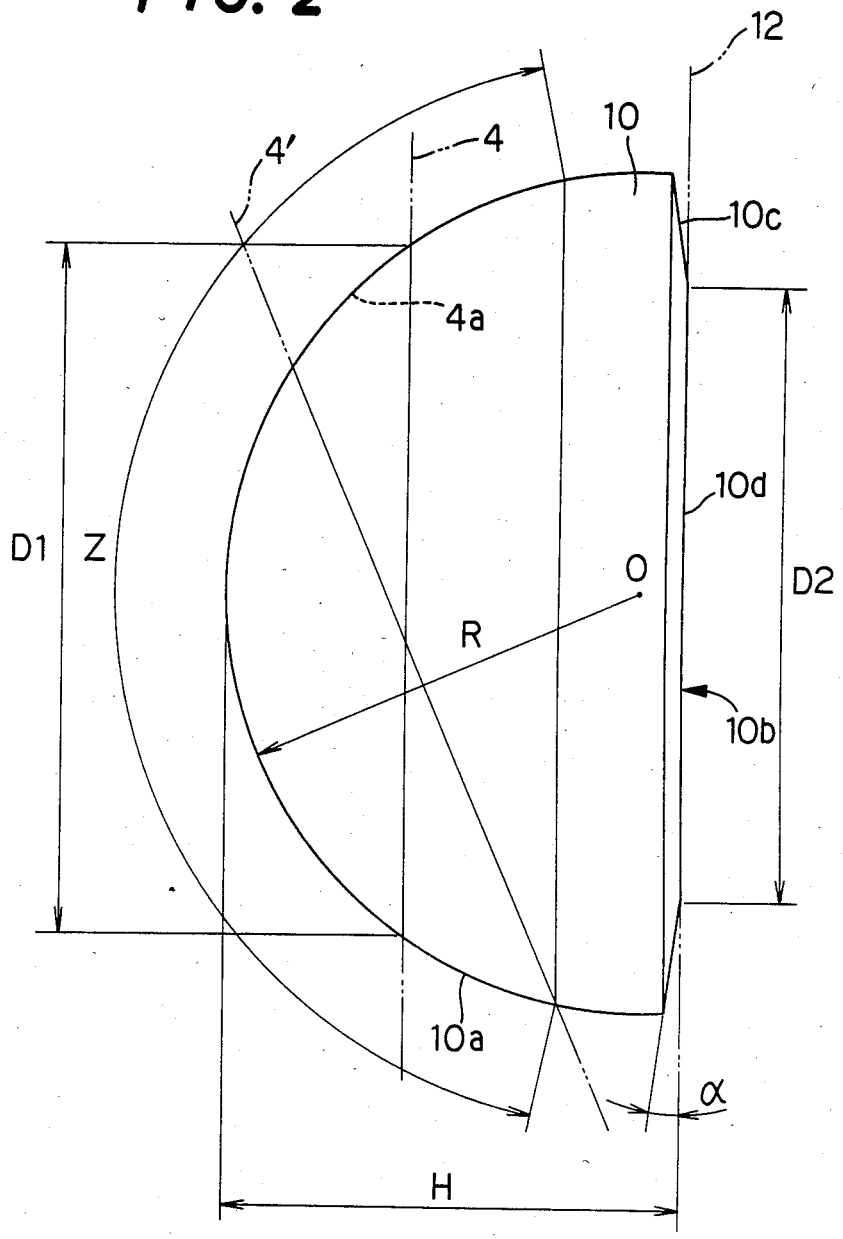
FIG. 2 is an elevational view of a shoe with a chamfered surface on the flat side thereof used in the compressor shown in FIG. 1.
Figure 3:
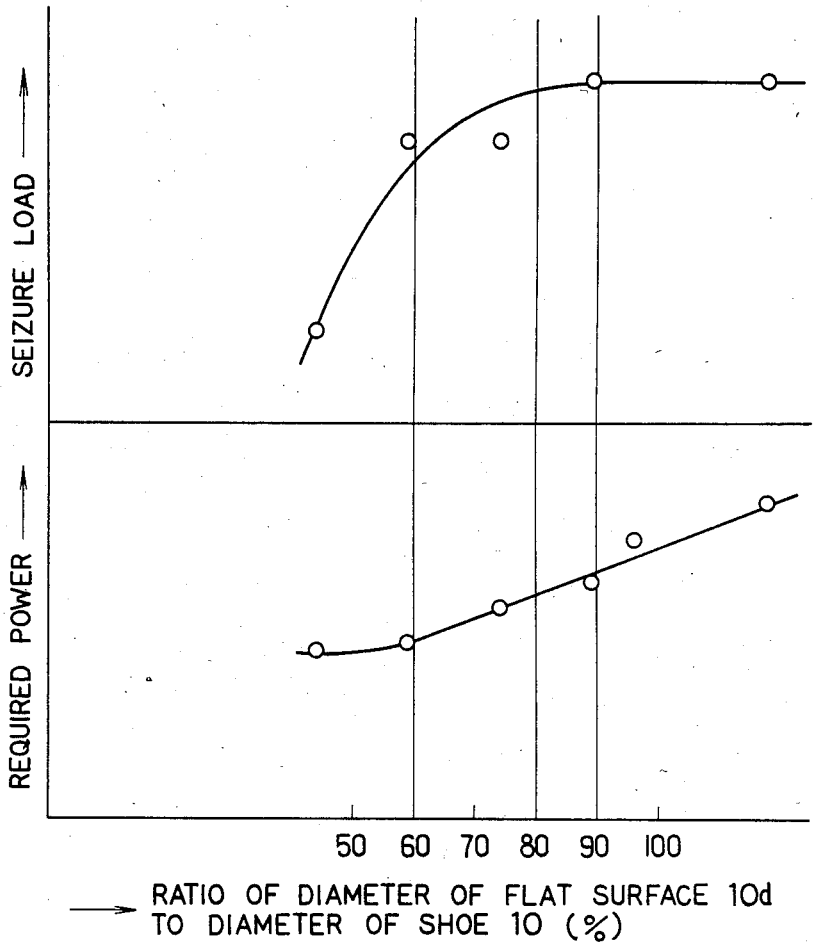
FIG. 3 is a graph showing operational characteristic of the shoe.

FIG. 2 illustrates the shoe 10 in an enlargement, which is of substantially semi-spherical shape with a radius R. It is formed in a state slightly larger than a true semi-sphere considering the convenience of holding the same when it is machined from a spherical body. Therefore the height H of the shoe 10 is slightly larger than the radius R. The convex spherical surface 10*a* of the shoe 10 is to be fittingly contacted with the concave spherical surface 4*a* formed in the piston 4, and the diameter D1 of an opening of the concave spherical surface 4*a* and the radius R of the convex spherical surface 10*a* (the radius of the concave spherical surface 4*a*) should be determined in consideration of the magnitude, kind of the load applied to the piston 4 and the machinability of the concave spherical surface 4*a* at the necessitated minimum value. On the outer portion or skirt portion of the flat-side surface of the shoe 10 a chamfered surface 10*c* is annularly formed with the angle of slant $\alpha$ against a flat surface portion 10*d* of the flat-side surface 10 so as to be of truncated conical shape. The angle of slant in this case is within the range of 0.5°–10°, and the chamfered surface 10*c* and the centrally left flat surface 10*d* are continued smoothly with a rounded portion. The formation of the chamfered surface 10*c* makes the diameter D2 of the flat surface 10*d* smaller than that of the whole flat-side surface 10*b*, which is substantially identical to the diameter 2R of the convex spherical surface 10*a*. The ratio of the diameter D2 against the diameter 2R of the convex spherical surface 10*a* of the shoe 10 is within the range of 60–90%, and it is preferred to be determined within 60–80%. The above-mentioned range is experimentally proved, as can be understood from the graph of FIG. 3, to be preferable: when the ratio exceeds 90% (the ratio can be over 100% in the most conventional type bearing device which uses a shoe and a ball) required power disadvantageously increases for the merit of holding down the rising trend of the seizure load, i.e., the load where seizure took place, and when the ratio is below 60% the seizure load is decreased without the merit of power economy, with a result of inviting a durability problem. What should be understood here is that the shoe 10 is, when the compressor in operation, in sliding contact at its Z region of the convex spherical surface 10*a* (see FIG. 2) with the concave spherical surface 4*a* of the piston 4 as illustrated with 4' for indicating the relative slant of the piston 4 against the shoe 10 at the maximum inclination of the swash-plate 8.

As for the operation of the compressor with the above-mentioned structures, the essential matter will be stated hereunder. Rotation of the swash-plate 8 driven through the drive shaft 5 will reciprocate the piston 4, which is engaged with the swash-plate 8 by way of the shoe 10, in the cylinder bore 1*a*, 2*a*, and the reciprocation movement of the piston 4 conducts suction and compression of the refrigerant gas for performing the proper function of the compressor. During this operation the shoe 10 is oscillated, according to variation of the contact angle of the swash-plate 8 to the shoe 10, as well as rotated about the axis thereof. Of course fairly heavy sliding between the flat-side surface 10*b* and the swash-plate 8 is produced due to a rapid revolving speed in the order of 23 m/sec., for example, under a high surface pressure in the order of 80 $Kg/cm^2$, for example.

The diameter of the flat surface 10*d* slidingly contacted with the swash-plate 8 is made slightly smaller than the diameter D1 of the opening of the concave spherical surface 4*a*, in this case, but the axial compression reaction force applied on the piston 4 can be sufficiently transmitted through the flat surface 10*d* to the swash-plate 8 while the sliding resistance between the shoe 10 and the swash-plate 8 can be reduced due to diminishing of the sliding contact area in comparison to the conventional device where a shoe of true semi-sphere shape was used. This has resulted advantageously in economy of the required power for driving.

Figure 4:
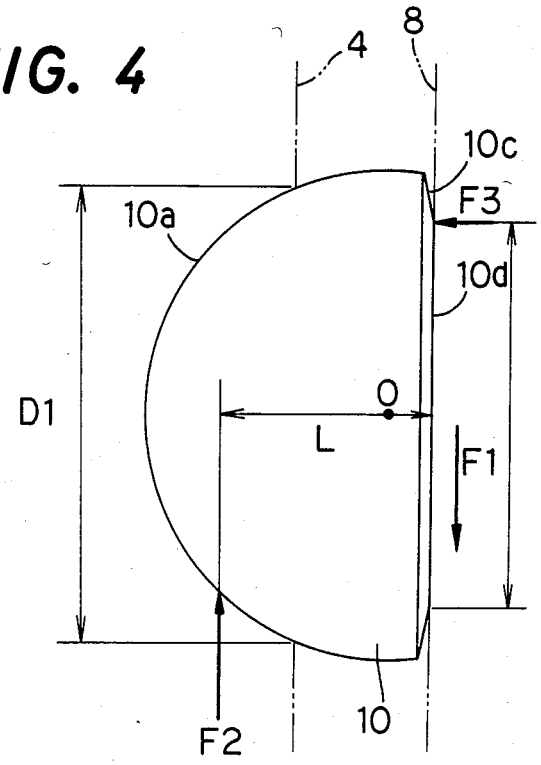
FIG. 4 is a diagram showing action or reaction forces applied to the shoe.

With reference to FIG. 4 the action or reaction forces produced here and there due to the sliding friction between the swash-plate 8 and the shoe 10 will be explained. Friction force F1 is produced by the sliding between the shoe 10 and the swash-plate 8. On the edge portion of the shoe 10 a reaction force $F3=F2 \cdot L/D2$ is applied because a moment $F2 \cdot L$, which tends to incline the shoe 10 with the reaction force F2 produced on the piston 4 owing to the friction force F1, arises (wherein L signifies distance from the flat surface 10*d* to the point of application of the reaction force). The reactionary force F3 can be made remarkably small in comparison to the most conventional bearing device including a ball and a shoe because of diminishing of the value L. Besides, the friction force F1 is made smaller than in the conventional case because of diminishing of the area of the flat surface 10*d*, i.e., the contact area between the shoe 10 and the swash-plate 8. So the flat surface 10*d* in this embodiment will not be affected, irrespective of its diameter diminishing, by abnormal amount of wear or seizure.

While the compressor is in operation the shoe 10 which is contacted at the flat surface 10*d* thereof with the swash-plate 8 and at the convex spherical surface 10*a* thereof with the piston 4 varies its posture according to the continuously varying slant angle of the swash-plate 8 in relation to the piston 4. As the closely located relation of the spherical center O of the shoe 10 and the center of the flat surface 10*d* will not largely vary the distance from the axis of the drive shaft 5 to the center of the flat surface 10*d*, which consequently restricts increasing of the resistance moment against the rotation of the swash-plate 8 caused by the increase of the just mentioned distance.

Figure 5:
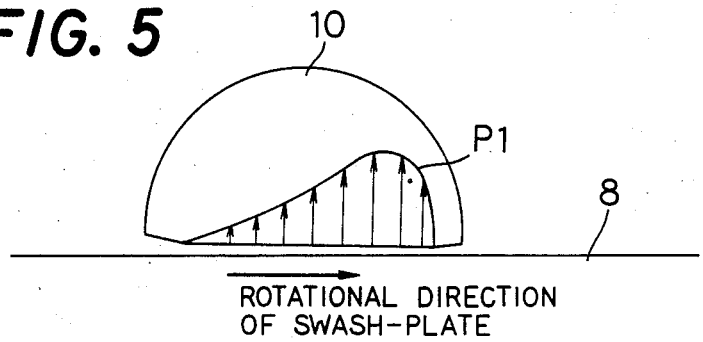
FIGS. 5 and 6 are respectively a diagram showing pressure distribution in an oil film formed between the shoe and a swash-plate.
Figure 6:
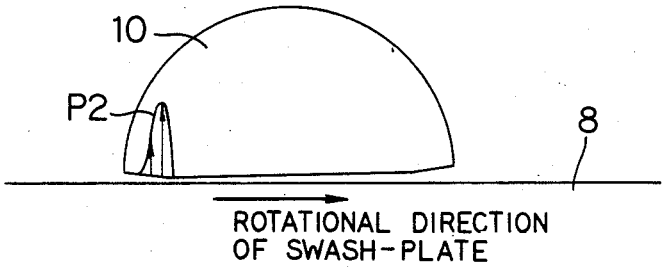

Due to the substantial semi-spherical configuration of the shoe 10, a part thereof nearest to the swash-plate 8 is almost perpendicular to the swash-plate 8, which favorably functions to effectively gather the lubricating oil attached on the surface of the swash-plate 8 in response to the relative sliding between the shoe 10 and the swash-plate 8 to the front side of the shoe, i.e., on the side facing the rotational direction of the swash-plate. This will serve to forming an oil film between the sliding surfaces of the two due to the so-called wedge effect caused by the chamfered surface 10*c*, and to effectively preventing dry friction. The shoe 10 varies its posture relatively to the swash-plate 8 in response to the rotation of the latter, and when the clearance formed between the shoe 10 and swash-plate 8 tends to close toward the rotational direction of the swash-plate 8 as shown in FIG. 5 oil film is formed sufficiently there in general, pressure distribution of the oil film being indicated by P1; on the contrary when the clearance between the two tends to open toward the rotational direction of the swash-plate 8 as shown in FIG. 6 the formation of an oil film is difficult. However, even in this latter case the chamfered surface 10*c* formed in this embodiment causes producing of oil film pressure P2 there which reversely raises the shoe 10 so as to rather close the clearance as shown in FIG. 5, with a final result of getting a sufficient oil film between the sliding surfaces. The angle of slant of the chamfered surface 10*c* is determined in this instance within the range of 0.5°–10°. An angle less than 0.5° is insufficient for the shoe 10 to correspond or answer to the change of posture of the shoe 10, and in case of more than 10° sufficient oil film is not formed between the shoe 10 and the swash-plate 8.

The shoe 10 can be made by machining with a lathe or the like from a spherical body, as mentioned earlier, and a possibly formed pressing-scar or depression due to chucking on the shoe 10 will not affect the later operation because the scar is left at a portion of the convex spherical surface 10*a* beside or wide of the Z area where the shoe is slidingly contacted with the concave spherical surface 4*a* of the piston 4. Although the shoe 10 is liable to get a scratch or indentation before being assembled due to bulk carrying or storing on the edge portion thereof, it does not matter at all to the operational function of the shoe 10, because of having the chamfered surface 10*c* on the flat-side surface 10*b*. The possible scratch on the edge portion will contact neither the swash-plate 8 nor the piston 4.

Figure 7:
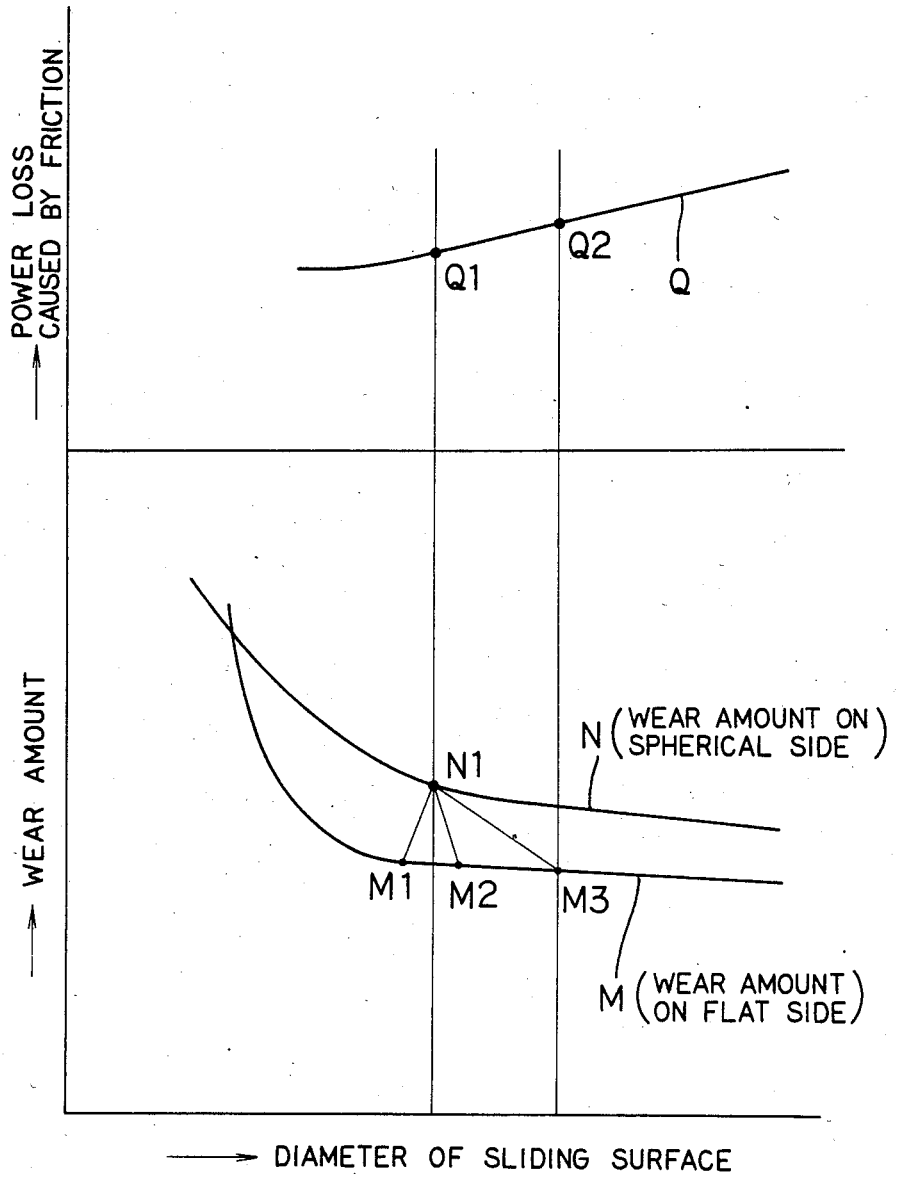
FIG. 7 is a graph showing a power loss diminishing merit of the invented shoe in comparison to conventional shoes.
Figure 8:
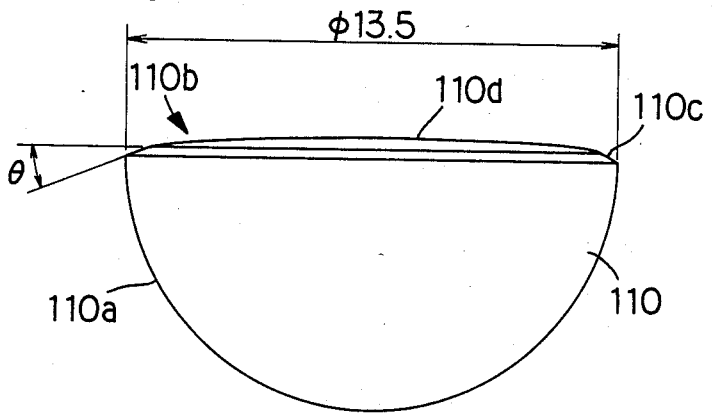
FIG. 8 is an elevational view of another shoe with a gentle convex surface on the flat side thereof used in another embodiment of the invention.

With reference to FIG. 7 relation of the wear amount and the power loss caused by the friction to the diameter of the sliding surface in the shoe 10 will be described. The sliding speed is slow on the spherical side than on the flat side of the shoe 10. When, however, the diameter of the sliding surface is reduced on both the spherical side and the flat side, because of the difficulty of fine machining on the concave spherical surface 4*a* of the piston 4, the wear amount begins to rapidly increase almost at the same point as illustrated. Relation of the wear amount of the flat surface 10*d* of the shoe 10 and the diameter of the sliding surface, i.e., the diameter D2 of the flat surface 10*d* is shown by a line M; and relation of the wear amount of the convex spherical surface 10*a* of the shoe 10 and the projection diameter of the sliding surface, i.e., the diameter D1 of the opening of the concave spherical surface 4a is shown by a line N. Furthermore, relation of the diameter of the sliding surface and the power loss is shown by a line Q. In such a situation the diameter D1 of the projection of the sliding surface with the piston 4 is determined at first. If the allowable minimum value, or diameter, N1 is selected along the line N, with an assumption of the shoe being a true semi-sphere body, diameter M3 of the sliding surface will necessarily coincide with the sphere diameter. Seeking a corresponded point of this diameter M3 on the line Q, the power loss is plotted at the point Q2. Contrary to the above, determination of the diameter of the projection of the spherical side at N1 point allows free selection of the diameter of the sliding surface on the flat side between, for example, M1 point and M2 point. Seeking a corresponded point on the line Q, the power loss will fall on a place near Q1 point, which suggests a great deal of power economy for the compressor driving.

As can be understood from the description on this embodiment, area of the sliding surface of the bearing device, i.e. the shoe 10, performing the engagement between the swash-plate 8 and the piston 4, can be determined at the necessary minimum, which enables reducing the friction and consequently power economizing and improving the durability through better lubrication of the sliding surfaces.

Another embodiment of this invention will be described next. The whole structure of this embodiment is similar to the previous one shown in FIG. 1, only exceptions are the swash-plate 8 which is made of Al-Si alloy just like the piston 4 for aiming light weight and the shoe 110 being different in shape and hardness.

Figure 9:
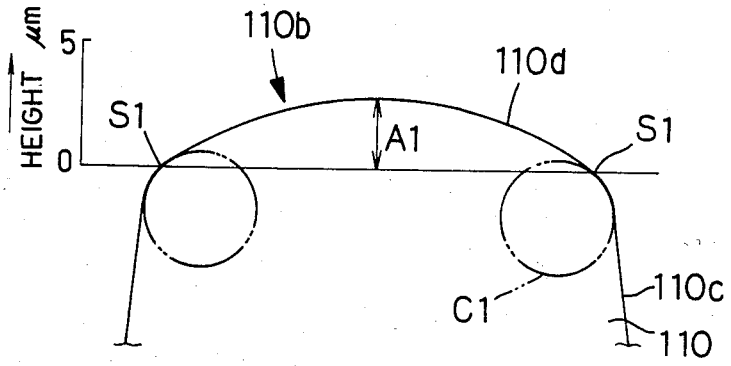
FIG. 9 is a diagram showing the profile, exaggerated or enlarged by a measuring instrument, of the flat-side surface of the shoe shown in FIG. 8.

The shoe 110 is provided with a convex spherical surface 110a and a flat-side surface 110b which is formed at the central part into a gentle convex surface 110d, more particularly a part-spherical surface with a extremely large radius of curvature with a peak at the center of 2–5 μm height, a most preferable value. On the outer portion of the flat-side surface 110b an annular chamfered surface 110c is formed so as to have a small angle of slant within the range of 5°–15° against the gentle convex surface 110d. The gentle convex surface 110d is so gently curved that it is almost unappreciable with naked eye. It is however perceivable with a measuring instrument so as to illustrate it as a profile in FIG. 9 in enlargement. The height A1 of the gentle convex surface 110d can be measured from a reference point S1 which is located at a contact point between a circle C1 which has a relatively small radius of curvature adjacent to the chamfered surface 110c and the gentle convex surface 110d.

The shoe 110 is made of steel JIS SUJ2 (corresponding to SAE 52100), hardened not less than hardness 60 $H_RC$.

When the compressor thus constructed is driven a severe or heavy sliding movement takes place between the shoe 110, the piston 4, and the swash-plate 8. Particularly when the lubrication system depending on the oil mist mixed in the refrigerant gas is employed, and the drive shaft 5 is driven at a low speed, the shoe 110 is liable to suffer from seizure due to shortage of lubrication. As the swash-plate 8 in this embodiment is made of an Al-Si alloy material which is featured in hardness and anti-wearing as well as strength, seizure can take place easily between the swash-plate 8 and the steel shoe 110.

In this embodiment the problematic seizure is well prevented by the gentle convex surface 110d formed on the flat-side surface 110b of the shoe 110 and the high hardness of the shoe 110 not less than 60 $H_RC$. This effect is due to the existence of the gentle convex surface 110d and the hardness of the shoe 110. The chamfered surface 110c is not an essential factor for the above-mentioned effect, but it actually contributes not a little to the seizure prevention through the wedge effect which it plays by positively taking the oil attached on the swash-plate 8 between the sliding surfaces so as to form an oil film.

Good prevention effect of seizure with the swash-plate 8 of Al-Si alloy by the gentle convex surface 110d and the hard material of the shoe 110 can be presumed for the following reasons; an wedge shaped clearance of small angle and gentle waning formed between the gentle convex surface 110d and the swash-plate 8 takes the lubricating oil attached on the swash-plate 8 into the clearance when high speed sliding takes place there so as to form an oil film for preventing the shoe 110 and the swash-plate 8 from direct contact, i.e., film lubricating owing to the wedge effect; the earlier mentioned oscillation of the shoe 110 varies at each rotation of the swash-plate 8 contact places between the two and increases the amount of the oil taken into there for betterment of the lubrication condition; and the high hardness of the shoe 110 such as 60 $H_RC$ well prevents a scratching on the both the shoe 110 and the swash-plate 8 of Al-Si alloy when solid friction or intermetallic contact takes place in starting or low speed driving time, which is effective in protecting both from being seized, that is, the kind or quality of material of both are mutually helpful in preventing the seizure.

Rightness of the above presumption is to be yet proved in the future course of studying, but the effects have already been testified in the following experiments.

EXPERIMENT I

Figure 10:
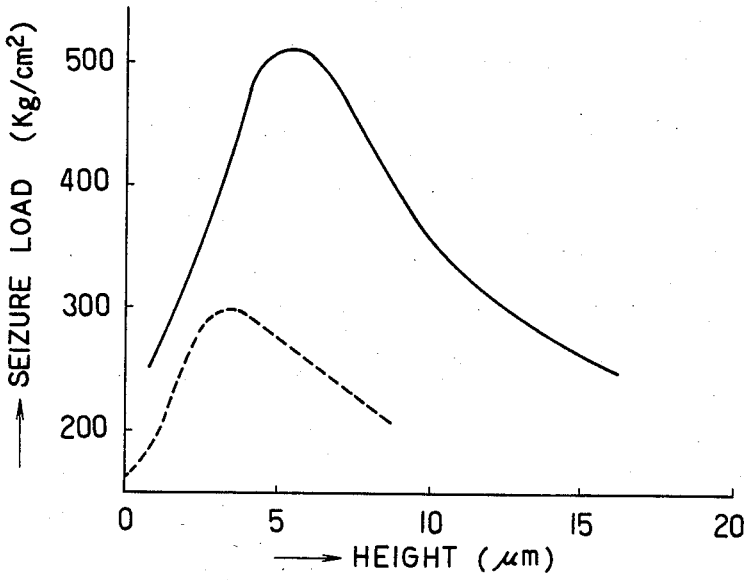
FIG. 10 is a graph showing seizure proof characteristic of the shoe shown in FIG. 8 in comparison with the shoe shown in FIG. 11.

The graph in FIG. 10 is for showing the experimental results wherein a test shoe 110 with a gentle convex surface 110d having the height A1 and another test shoe without the gentle convex surface were similarly urged onto a rotary disc of the same material as the swash-plate 8 under gradually increasing urging force for measuring respectively the urging load where the seizure took place, i.e., seizure load. And test conditions applied then were as undermentioned.

| | |
|---|---|
| Sliding speed between the rotary disc and the shoe: | 15 m/sec. |
| Urging load: | gradually increased 20 Kg/20 min. |
| Lubrication condition: | pad oiling system where lubricating oil is applied via a felt pad on the disc at a rate of approximately 0.4 cc/min. |
| Kind of oil: | mixture of ice machine oil 1/gas oil 9 |
| Shoe: | material; steel JIS SUJ2 (SAE 52100)<br>hardness; 60 $H_RC$ or more<br>diameter of the spherical portion; 13.5 mm<br>surface roughness; 0.3 μm or less |
| Rotary disc: | straightness; 1 μm–1.5 μm<br>material; Al—Si alloy (A 390), Si content 18%<br>surface roughness; 0.7 μm or less |

According to FIG. 10, a shoe having a gentle convex surface 110d, even when the height A1 is extremely small, showed the seizure load exceeding 250 Kg as described with a solid line; when the height A1 is about 5 μm the seizure load was maximum, exceeding 500 Kg. Further increasing of the height A1 deteriorated the test result, reaching the value less than 250 Kg at the height 15 μm.

Figure 11:
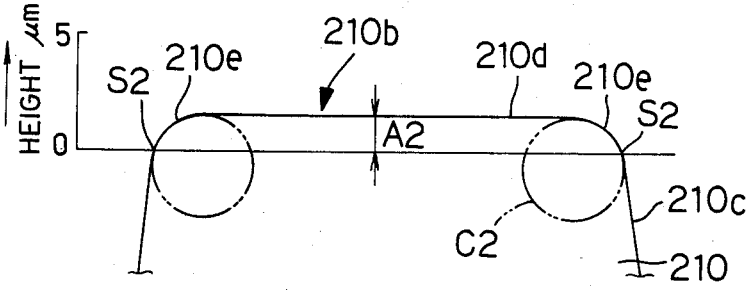
FIG. 11 is a diagram showing the profile of the flat-side surface of a shoe without a gentle convex surface which is made to compare with the shoe shown in FIG. 9 and prove the effect of the gentle convex surface.

On the other hand, a shoe 210 shown in FIG. 11 which did not possess a gentle convex surface but possessed only a flat surface **210*d* on its flat-side surface 210*b* produced the test results shown on the graph of FIG. 10 with a broken line, wherein the seizure load was maximum, i.e., 300 Kg when a rounded portion formed by a circle C2 between the chamfered surface 210*c* and the flat surface 210*d* was 3 μm. Either increasing or decreasing of the size of the circle C2 made worse the test results, i.e., decreased the seizure load. Incidentally the height A2 in this case was determined by taking from a contact point S2 where the circle C2 having the radius of curvature of the rounded portion and the chamfered surface 210*c* met up to the flat surface 210*d*. Conclusively speaking, a shoe provided with the gentle convex surface 110*d* was always far superior to that without the gentle convex surface in respect of the seizure load, and the height A1 of the gentle convex surface 110*d*** not exceeding 15 μm stably kept a high level seizure load 250 Kg or more.

EXPERIMENT II

Figure 12:
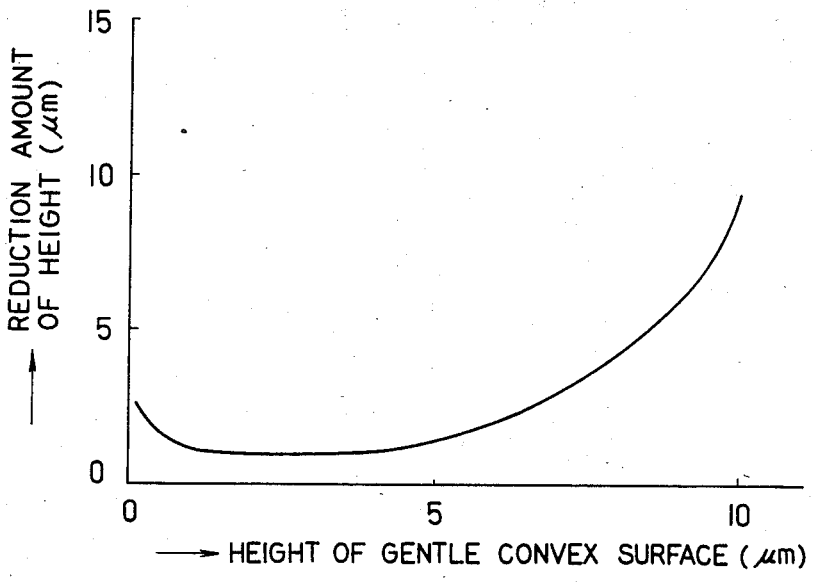
FIG. 12 is a graph showing wear proof characteristic of the shoe shown in FIG. 8.

Test shoes having different height A1 were respectively urged onto a rotary disc of the same material (Al-Si alloy A 390) as the swash-plate 8 under a constant load, for investigating the relation between the height A1 of the gentle convex surface **110*d* and the amount of wear. Decreased amount of the height A1 after a predetermined time duration due to the wearing by the rotation of the disc are shown in the graph of FIG. 12**. Test conditions applied were as undermentioned.

| | |
|---|---|
| Sliding speed between the rotary disc and the shoe: | 15 m/sec. |
| Urging load per unit area of the shoe: | 100 Kg/cm$^2$ during the breaking-in or running-in 25 Kg/cm$^2$) |
| Test time: | 100 hours (after the breaking-in or running-in of 30 minutes) |
| Lubrication condition and kind of oil: | same in Experiment I |
| Shoe: | material; steel JIS SUJ2 (SAE 52100) surface roughness; 0.3 μm or less diameter of the spherical portion; 13.5 mm |
| Rotary disc: | same in Experiment I |

According to the graph in FIG. 12 the height A1 of the gentle convex surface **110*d* exceeding 7 μm remarkably increases the reduction amount of the height A1, i.e., increases rapidly the wearing amount of the shoe 110**. This increasing of the wear of the shoe causes loosening or slackening among the three of the shoe, the piston, and the swash-plate, which will invite vibration, rattling, and eventually life-shortening of the compressor.

From the above two Experiments, preferable height of the gentle convex surface where the seizure load is improved while holding down the wear amount of the shoe 110 can be concluded as 7 μm or less, and more preferably to be within the range of 2–5 μm.

EXPERIMENT III

While using test shoes and a rotary disc respectively conditioned as shown in TABLE I in respect of material and other factors, the time before the shoes began to show the seizure when they were placed under a constant predetermined load upon the rotating disc were measured. The results shown in FIGS. 13 and 14 were obtained under the following test condition.

| | |
|---|---|
| Sliding speed between the rotary disc and the shoe: | 15 m/sec. |
| Urging load per unit area of the shoe: | 120 Kg/cm$^2$ (during the running-in 25 Kg/cm$^2$) |
| Test time: | 50 hours (maximum) |
| Lubrication condition: | pad oiling system |
| Kind of oil: | mixture of ice machine oil 1/gas oil 9 |
| Shoe: | diameter of the spherical portion; 13.5 mm height of the gentle convex surface; 3 μm surface roughness of the gentle convex surface; 0.3 μm or less |
| Rotary disc: | straightness; 1.0 μm–1.5 μm surface roughness; 0.7 μm or less Al—Si alloy (10–25% Si) |

TABLE I

| SAMPLE No. | Shoes Hardness ($E_RC$) | Shoes Material | Rotary disc Material | Rotary disc Si content (wt %) |
|---|---|---|---|---|
| 1 | 30 | Steel JIS SUJ2 (SAE 52100) | Al—Si alloy | 18 |
| 2 | 50 | Steel JIS SCr415 (AISI 5115) | Al—Si alloy | 10 |
| 3 | 60 | Steel JIS SCM415* | Al—Si alloy | 25 |
| 4 | 63 | Steel JIS SUJ2 (SAE 52100) | Al—Si alloy | 25 |
| 5 | 63 | Steel JIS SCr415 (AISI 5115) | Al—Si alloy | 18 |
| 6 | 67 | Steel JIS SCM415 | Al—Si alloy | 25 |
| 7 | 50 | Steel JIS SUJ2 (SAE 52100) | Al—Si alloy | 18 |
| 8 | 67 | Steel JIS SUJ2 (SAE 52100) | Al—Si alloy | 18 |
| 9 | 40 | Steel JIS SCr415 (AISI 5115) | Al—Si alloy | 10 |
| 10 | 50 | Steel JIS SCM415 | Al—Si alloy | 10 |
| 11 | 67 | Steel JIS SCr415 (AISI 5115) | Al—Si alloy | 18 |
| 12 | 60 | Steel JIS SUJ2 (SAE 52100) | Al—Si alloy | 18 |
| 13 | 20 | Phosphor bronze (SAE C90700) | Al—Si Alloy | 18 |
| 14 | 20 | High strength brass (ASTM C865) | Al—Si alloy | 18 |

*foot-note
steel containing by weight %
C: 0.13–0.18
MN: 0.60–0.85
Cr: 0.90–1.20
Mo: 0.15–0.30

Figure 13:
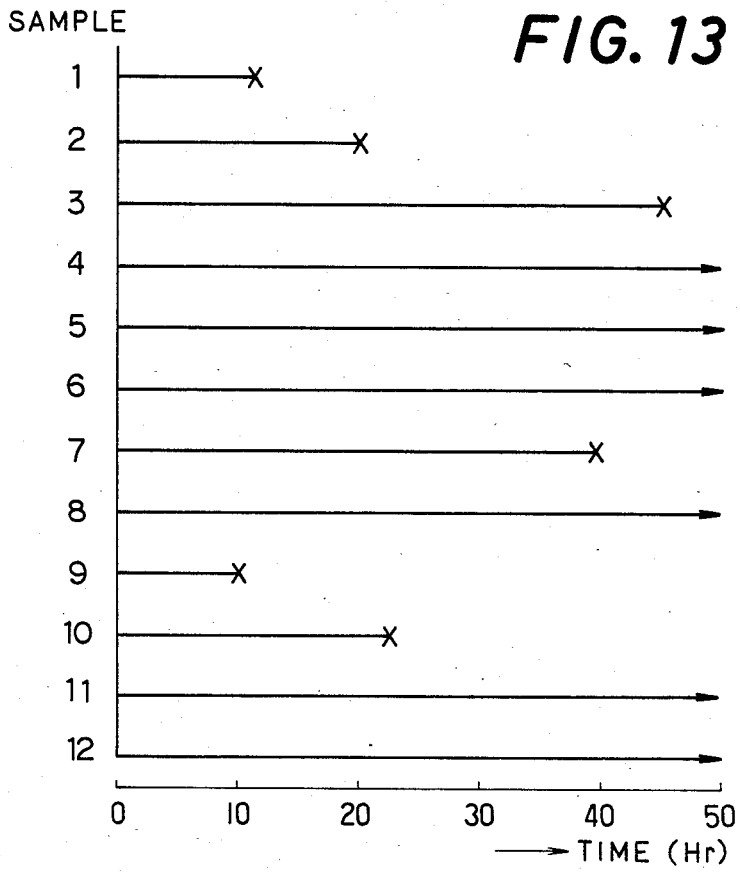
FIGS. 13 and 14 are graphs showing the result of a seizure proof test of the shoe shown in FIG. 8.
Figure 14:
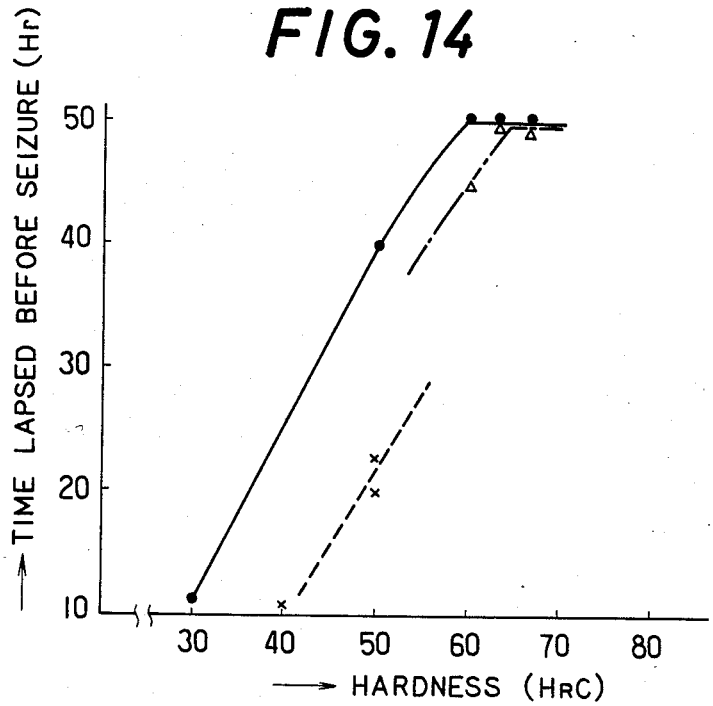

According to FIGS. 13 and 14 the time before the beginning of seizure was not so greatly influenced by the steel species of the shoe and the Si content of the Al-Si alloy of the rotary disc, but the hardness of the shoe was the greatest factor for determining that time. The harder the material was, the longer became the time before the seizure, i.e., the seizure was less liable to happen. The hardness 50 $H_RC$, was practicably satisfactory in respect of seizure prevention, and that more than 60 $H_RC$ was farther preferable. Incidentally, x make in FIG. 13 indicates taking place of seizure, and the solid line, the broken line, and the one-dot-chain line respectively indicate silicon content of the Al-Si alloy at 18%, 10%, and 25%. And the hardness of the Al-Si alloy was 17–42 by the Rockwell scale B ($H_RB$), at the range of silicon content 10%–25%.

EXPERIMENT IV

Employing a swash-plate type compressor of gross displacement capacity of 150 cc/rev., with various amount of sealed lubricating oil, being 10 steps in this test, observation after a predetermined time of severely conditioned driving was conducted whether the seizure had took place or not. Tests carried out with the material condition in TABLE I on the shoe and the rotary disc, under the 10 stepped oil amount condition shown in TABLE II, showed the results as can be seen in TABLE II and FIG. 15. The conditions of the experiment were as follows:

| | |
|---|---|
| Number of rotation: | 4000 r.p.m. (revolution/min.) |
| Discharge pressure of the refrigerant: | 4–6 Kg/cm$^2$ |
| Suction pressure of the refrigerant: | approx. −50 mm Hg |
| Operation time: | 20 hours |
| Amount of the refrigerant sealed: | 100 g (10% of the standard volume) |
| Shoe and the swash-plate: | same as the conditions of the shoe and the rotary disc in Experiment III |
| Lubrication oil: | ice machine oil |
| Amount of the oil sealed: | 100–270 cc |
| Swash-plate: | Al—Si alloy (10–25% Si) |
| Piston: | Al—Si alloy JIS AC8A (SAE 321) |

TABLE II

| SAMPLE NO. | AMOUNT OF SEALED LUBRICATING OIL (cc) | | | | | | | | | |
|---|---|---|---|---|---|---|---|---|---|---|
| | 270 | 240 | 220 | 200 | 180 | 160 | 140 | 120 | 100 | 80 |
| 1 | X | | | | | | | | | |
| 2 | | | ○ | Δ | X | | | | | |
| 3 | | | | ○ | Δ | X | | | | |
| 4 | | | | | | | ○ | Δ | X | |
| 5 | | | | | | ○ | Δ | X | | |
| 6 | | | | | | ○ | Δ | X | | |
| 7 | | | | | ○ | X | | | | |
| 8 | | | | | | | ○ | Δ | X | |
| 9 | ○ | Δ | X | | | | | | | |
| 10 | | | | ○ | Δ | X | | | | |
| 11 | | | | | | ○ | Δ | X | | |
| 12 | | | | | | | ○ | Δ | X | |
| 13 | X | | | | | | | | | |
| 14 | X | | | | | | | | | |

Figure 15:
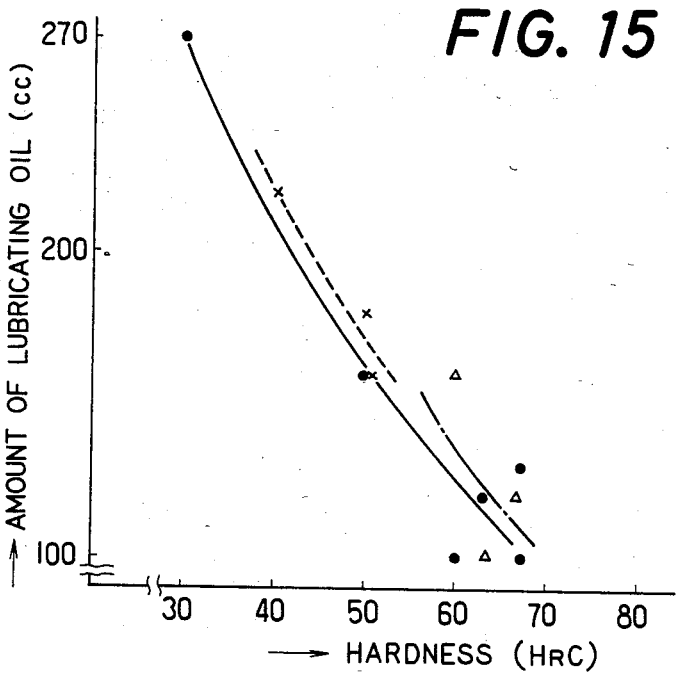
FIG. 15 is a graph showing relation between hardness of the shoe and required amount of lubricating oil for preventing the seizure between the shoe and the swash-plate.

According to TABLE II and FIG. 15, observation result of the amount of the sealed lubricating oil when the seizure happened was not so different depending on the material and kind of the shoe or on the silicon content of the Al-Si alloy for the swash-plate, but the material hardness of the shoe was the main factor for determining the oil amount in respect of causing the seizure. It proved that the harder the shoe material became, the less became the oil amount, i.e., if the shoe material the harder became it could bear under the severer condition of lubrication before the seizure took place. It means that seizure will not happen, if the shoe material is sufficiently hard, even under a most severe lubrication condition such as being placed under a low speed driving of the compressor. In this experiment, too, it was well proved that the hardness of the shoe not less than 50 $H_RC$ was practically satisfactory and that over 60 $H_RC$ was farther preferable.

In TABLE II, ○ mark, Δ mark, and x mark indicate respectively a non-seizure state for all test pieces, a partially seizure happened state among a plurality of test pieces, and a state wherein all of the test pieces were seizured. And the solid line, the broken line, and the one-dot-chain line in FIG. 15 respectively show the silicon content of the Al-Si alloy at 18%, 10%, and 25%.

According to the Experiments III and IV, the following conclusions can be obtained. Under the condition that the swash-plate 8 is of Al-Si alloy and the shoe 110 is provided with on its flat-side surface **110*b* a gentle convex surface 110*d*, the shoe 110 can be prevented from seizure in general so long as the shoe material has the hardness not less than 50 $H_RC$ and surely prevented therefrom if the hardness exceeds 60 $H_RC$. And smoothness of the swash-plate 8 and gentle convex surface 110*d* of the shoe 110 is also highly preverable for preventing the seizure. As to the surface roughness of the swash-plate 8 less than 1 μm is preferable and 0.7 μm or less is farther preferable. As to the surface roughness of the shoe 110 less than 1 μm is preferable and 0.3 μm or less is farther preferable. In respect of the angle of slant that the chamfered surface 110*c* forms against the gentle convex surface 110*d*** for positively taking the lubricating oil thereinto the range of 1°–45° is considered to be preferable and the range of 5°–15° is far more preferable for the formation of the oil film.

Figure 16:
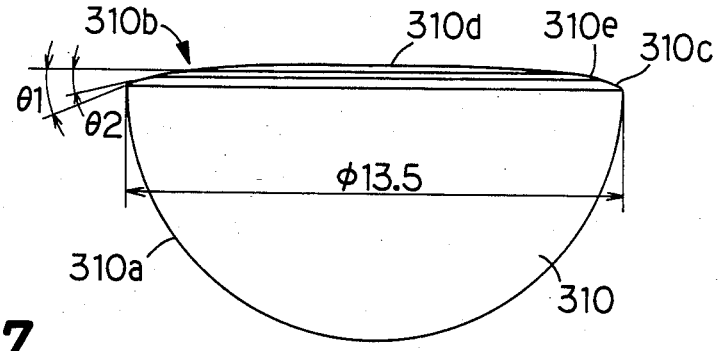
FIG. 16 is an elevational view of another shoe used in another embodiment of this invention.
Figure 17:
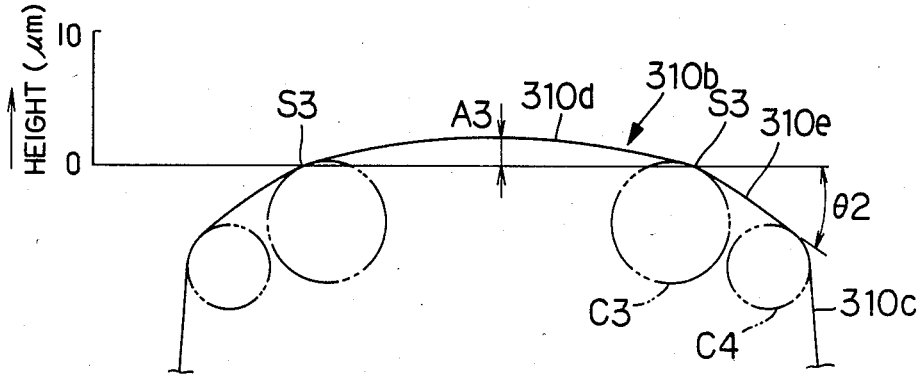
FIG. 17 is a diagram showing an exaggerated profile of the flat-side surface of the shoe shown in FIG. 16.

A shoe 310 for being employed in another embodiment of this invention is shown in FIG. 16. This shoe 310 is provided with a gentle convex surface **310*a* and a flat-side surface 310*b* so as to be of semi-spherical shape. The shoe 310 is hardened not less than 50 $H_RC$. The flat-side surface 310*b* is, as shown in FIG. 17, formed into a smooth and gentle convex surface 310*d* having an extremely large radius of curvature with its peak in the central portion with a most preferable height in the range of 2–5 μm. On the outer portion of the flat-side surface 310*b* is made into a first annular chamfered surface 310*c* which forms an angle of slant 20°–45° against the gentle convex surface 310*d*. And between the first chamfered surface 310*c* and the gentle convex surface 310*d* a second annular chamfered surface 310*e* is formed with an angle of slant 5°–10° smaller than the just mentioned one against the gentle convex surface 310*d*. Both border lines between the gentle convex surface 310*d* and the second chamfered surface 310*e*, and between the second chamfered surface 310*e* and the first chamfered surface 310*c* are formed respectively into a smoothly curved surface, i.e., a rounded portion with a suitable radius of curvature by getting rid of the angled portion for the purpose of preventing possible happening of a scratch or scratches on the sliding surface of the swash-plate 8. The height of the gentle convex surface 310***d* is measured as a distance from a contact point S3 of a circle C3 and the gentle convex surface 310*d*, up to the peak of the gentle convex surface 310*d*. The slant angle of the first chamfered surface 310*c* and the second chamfered surface 310*e* $\theta 1$ and $\theta 2$ are respectively measured with an enlarging projector. If and when the slant angle of the second chamfered surface 310*e* is very small the angle $\theta 2$ is measured, by describing a tangent line to each of two circles C3, C4 which respectively has a radius of curvature corresponding to the border curved or rounded portions on either side of the second chamfered surface 310*e* for determining the angle formed between the tangent line and the horizontal line. Formation of both the first and second chamfered surfaces is effective in diminishing the dispersion or wide variety of the seizure load among many shoes. This merit has been ascertained in the following experiment.

EXPERIMENT V

Many test shoes or samples having the first and second chamfered surfaces 310*c*, 310*e*, being respectively different in the slant angle thereof as shown in TABLE III, were tested under the test conditions similar to those in Experiment I for observing the seizure load in each of them. The result data are shown in the graph of FIG. 18.

TABLE III

| SAMPLE NO. | Height of the gentle convex surface (Al) | Slant angle of the second chamfered surface ($\theta 2$) | Slant angle of the first chamfered surface ($\theta 1$) | Diameter ratio of the gentle convex surface to the flat-side surface | Amount of chamfering |
|---|---|---|---|---|---|
| 1 | 4 μm | 0° | 10° | 80% | 0.3 mm |
| 2 | 4 μm | 0.5° | 2° | 60% | 0.3 mm |
| 3 | 4 μm | 5° | 20° | 75% | 0.3 mm |
| 4 | 4 μm | 10° | 45° | 95% | 0.3 mm |
| 5 | 4 μm | 15° | 25° | 75% | 0.3 mm |

Figure 18:
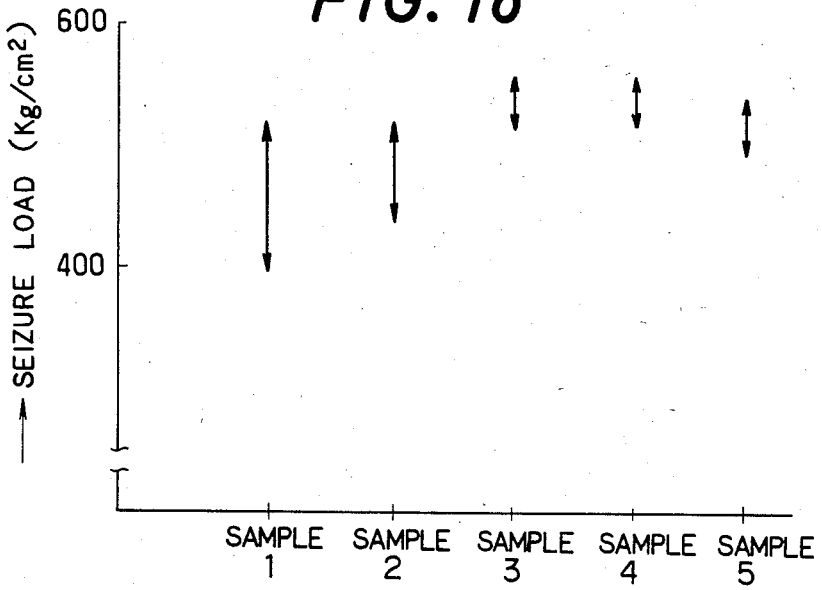
FIG. 18 is a graph showing the merit in respect of seizure load of the shoe shown in FIG. 16.

According to the graph of FIG. 18 a shoe which has the second chamfered surface 310*e*, even when it is very small, is very effective in comparison to a shoe without the same in diminishing the dispersion of seizure load among many shoes. The slant angle $\theta 2$ of the second chamfered surface 310*e* exceeding 5° is effective in raising the seizure load and stabilizing it by eliminating the dispersion. And the slant angle $\theta 1$ of the first chamfered surface 310*c* should be always larger than that $\theta 2$ of the second chamfered surface 310*e*. Range of the slant angle $\theta 2$ for the second chamfered surface 310*e* 0.5°–15° combined by the range of the slant angle $\theta 1$ for the first chamfered surface 310*d* 1°–45° is practically passable for the purpose. Most preferable combination of the slant angles is the range 5°–10° of the angle $\theta 2$ for the second chamfered surface 310*e* and that 20°–45° of the angle $\theta 1$ for the first chamfered surface 310*c*.

In still another embodiment of this invention a coated shoe of one of the above-mentioned shapes with a film containing solid lubricant (hereinafter called solid lubricating film) is employed. As the solid lubricant a variety of materials are allowable such as molybdenum disulphide ($MoS_2$), graphite (C), boron nitride (BN), tungsten disulphide ($WS_2$), polytetrafluoroethylene [$(CF_2—CF_2)_n$], etc. Most solid lubricants are, as widely known, of stratiform or flaky form so as to be lubricant owing to mutual slidability between the layers therein. The slidability depends, however, largely or various conditions, for example, crystal structure, purity, particle shape, distribution of particle size, so strict selection of the best suited material for the purpose according to the utilization conditions or the object of utilization has to be done in the actual use thereof. In our experiments a combination or a mixture of the four highly refined materials, physically and chemically in respect of the crystal structure, purity, particle shape, and the particle size distrution, of molybdenum disulphide, boron nitride, graphite, and polytetrafluoroethylene was proved as the best. In particular a combination of the four refined materials of the solid lubricant bound by a binder of phenolic resin or epoxy resin, which is a sort of thermoplastic resin, was remarkably effective for forming a solid lubricating film.

Figure 19:
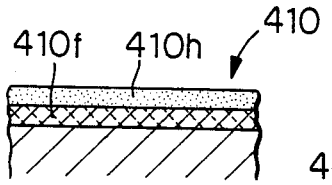
FIG. 19 is a sectional view of a part of another sheo used in another embodiment of the invention.

Forming method of a solid lubricating film, by taking up this case, will be explained hereunder. A shoe to be coated is at first treated in an alkaline solution such as sodium hydroxide for degreasing at a temperature of 60°–70° C., followed by a next step of water washing and hot water washing for removing the remaining alkali from the surface thereof. It is then immersed in an aqueous solution of phosphate of manganese at a temperature of 85°–95° C. so as to form a film of manganese phosphate on the surface thereof as an under layer. If a promotor is put in the aqueous solution of the manganese phosphate, when necessitated, shortening of the treatment time will be effectively realized. After having washed with hot water and dried with hot air the subject shoe, covered by a manganese phosphate layer, spray coating of suspension of the above-mentioned coating material which has been diluted with a proper diluent will be added. Baking of the test shoe at 180° C. for half an hour or at 150° C. for an hour will firmly form a solid lubricating film 410*h* as desired over the under layer of the manganese phosphate 410*f* so as to produce a finished shoe 410 shown in FIG. 19. Incidentally it is inevitable as a necessary tendency that the solid lubricating film 410*h* is subjected to plastic flow and wear by friction in an actual use in a compressor, and consequently decreased in the thickness thereof. Decreasing of the thickness of the solid lubricating film 410*h* will naturally cause to produce a clearance between the shoe 410 and the piston 4 or the swash-plate 8, which is liable to give rise to vibration or rattling in the compressor. So it is preferable to adjust the spray coating conditions so as to hold down the thickness of the solid lubricating film 410*h* including that of the under layer 410*f* of the manganese phosphate to less than a predetermined value, generally less than 10 μm, preferably less than 7 μm, and most desirably to less than 5 μm. By the way, the treatment by the phosphate is liable to bring about hydrogen embrittlement of the subject shoe owing to occlusion of the then produced hydrogen; it is recommendable to execute degassing by heating for a certain time, as occasion demands, for evading the embrittlement in question. It goes without saying that some other coating materials, in addition to the above recommended coating material can be used along with other methods of treatment. As an under layer zinc phosphate, chromate, etc., are permissible, besides nitride layer formed by soft nitriding, such as tufftriding (a kind of liquid nitriding method executed by immersing in a content controlled salt bath of cyanide (NaCN, KCN)-cyanate (NaCNO, KCNO)), is also not bad. Elimination of the pretreating or forming of under layer is also allowed in some cases, and as to the method of coating the solid lubricating film, tumbling, immersing, brushing, etc., are allowable, in addition to the spraying method. As another method of forming the solid lubricating film formation of diffusion layers of iron sulfide of hexagonal system formed by low temperature sulphurizing and susceptible to cleavage on the surface of the shoe can be introduced here.

In a compressor provided with a shoe 410 having such a lubricating film, friction and consequently power loss can be remarkably reduced owing to the smooth sliding of the shoe 410, which will be described in detail hereunder.

Slidingly contacted surfaces of the shoe 410, the swash-plate 8 and the piston 4 are all full of minute indentations, irregularities, or cracks in some cases, when observed microscopically, so shortage of lubrication between the contacted surfaces will cause microscopic or local seizure followed by increasing of the friction force. The cracks will some time allow ingress of lubricating oil, on which pressure applied on the oil film is delivered so as to finally open them forcibly, and the parts surrounding the cracks are broken to scatter fine broken pieces over the sliding surfaces. The scattered broken pieces will scratch the sliding surfaces to increase the surface roughness there followed by farther increase of friction force.

The coated solid lubricating film 410*h* advantageously fills or covers the cracks, indentations, etc. and furthermore smoothes the small projections to be flat so as to increase actual contact area between the shoe 410 and the piston 4 with a result of improving fitness between the two members. In other words, the shoe 410, the swash-plate 8 and the piston 4 are contacted uniformly over a wider area, reducing the surface pressure between the two. This well fitted contact aided by the proper lubricating function of the solid lubricant serves to reduction of the friction and consequently to reduction of the power loss. The coated solid lubricating film contributes to both the lubricating function of its own quality and the smoothening or covering function of the irregular surface. Therefore shoes formed by forging method, wherein wavy or indented surfaces are after formed, are well covered by this solid lubricating film. This coating method can be said particularly effective for being advantageously applied to forged shoes conventionally regarded as weak in attaining the spherity of the spherical surface and diminishing the surface roughness, which leads to reducing the manufacturing cost of the shoes. The cost in forging method is about two thirds as much as that in the shoe forming method from a steel ball by cutting.

How greatly the above-mentioned solid lubricating film formed on the shoe 410 contributed to reducing the power loss was ascertained by the experiments executed by the inventor which were aimed to investigate the coefficient of friction of the coated film, measurement of the extent of seizure in addition to the measurement of the power loss.

EXPERIMENT VI

Test shoes having the same shape as the afore-mentioned shoe 110 made by forging were classified into four kinds by varying the test conditions into four ways, in respect of the kind of pretreating, kind of coating material, and method of coating, as shown in TABLE IV. The degreasing treatment, baking treatment, etc., were executed in almost similar conditions as in earlier stated ones. The test shoes 1–4 obtained under the conditions of TABLE IV were applied to the undermentioned experiment, together with the test shoes in sample 5 made by forging and those in sample 6 made by cutting steel balls into half for the purpose of comparison.

Figure 20:
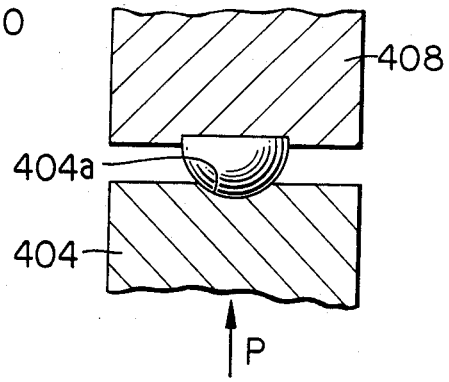
FIG. 20 is a schematic section of a test machine used for testing the shoe shown in FIG. 19.

As shown in FIG. 20, the spherical side of a test shoe was contacted, in lubricating oil, with the concave spherical surface 404*a* of a block 404 made of a similar material of the piston 4 under the urging load of 100 Kg, and the flat side of the test shoe was fixed to a rotary member 408. The rotary member 408 was rotated at a speed of 500 r.p.m., and the coefficient of friction was measured after the elapse of 10 minutes and 60 minutes.

TABLE IV

| Conditions | Samples (shoes) 1 | | 2 | | 3 | | 4 | |
|---|---|---|---|---|---|---|---|---|
| Pretreating | Film of manganese phosphate (Film thickness approx. 3 μm) | | Film of manganese phosphate (Film thickness approx. 3 μm) | | Film of manganese phosphate (Film thickness approx. 3μm) | | Soft nitriding (Film thickness approx. 3μm) | |
| Coating Material | | (wt %) | | (wt %) | | (wt %) | | (wt %) |
| | $MoS_2$ | 20 | $WS_2$ | 40 | $MoS_2$ | 20 | $MoS_2$ | 30 |
| | Graphite | 20 | $(CF_2—CF_2)_n$ | 20 | BN | 10 | Graphite | 20 |
| | Phenolic resin (Film thickness approx. 1.5 μm) | balance | Epoxy resin (Film thickness approx. 5 μm) | balance | Graphite | 20 | $(CF_2—CF_2)_n$ | 10 |
| | | | | | $(CF_2—CF_2)_n$ | 20 | Phenolic resin (Film thickness approx. 7μm) | balance |
| | | | | | Epoxy resin (Film thickness approx. 3 μm) | balance | | |
| Method of coating | Tumbling | | Spraying | | Immersing | | Tumbling | |

TABLE V

| | | Samples | | | | | |
|---|---|---|---|---|---|---|---|
| | | 1 | 2 | 3 | 4 | 5 | 6 |
| 10 minutes | Central value (Median) | 0.1 | 0.11 | 0.09 | 0.1 | 0.15 | 0.13 |
| | Width of variation | 0.09–0.11 | 0.09–0.13 | 0.085–0.095 | 0.09–0.11 | 0.14–0.16 | 0.12–0.14 |
| 60 minutes | Central value (Median) | 0.1 | 0.11 | 0.09 | 0.1 | 0.17 | 0.14 |
| | Width of variation | 0.09–0.11 | 0.09–0.13 | 0.085–0.095 | 0.09–0.11 | 0.14–0.2 | 0.12–0.16 |

As can be clearly observed in the above TABLE, the coefficients of friction in the samples 1–4 which are coated with solid lubricating film far less than in those 5, 6 which do not have the solid lubricating film, which eloquently proves the friction reducing effect of the solid lubricating film.

EXPERIMENT VII

Using the same kind of samples (test shoes) and apparatus as in Experiment VI, the time duration until seizure began was measured under the set condition of:

urging load; 20 Kg rotation speed; 300 r.p.m.

The test was executed in the ambient atmosphere without lubrication. From the result shown in TABLE VI the remarkable role of seizure prevention played by the solid lubricating film can be clearly understood.

TABLE VI

| SAMPLES (shoes) | TIME DURATION UNTIL SEIZURE BEGAN |
|---|---|
| 1 | about 80 minutes |
| 2 | about 100 minutes |
| 3 | about 90 minutes |
| 4 | about 120 minutes |
| 5 | about 30 minutes |
| 6 | about 50 minutes |

EXPERIMENT VIII

Figure 21:
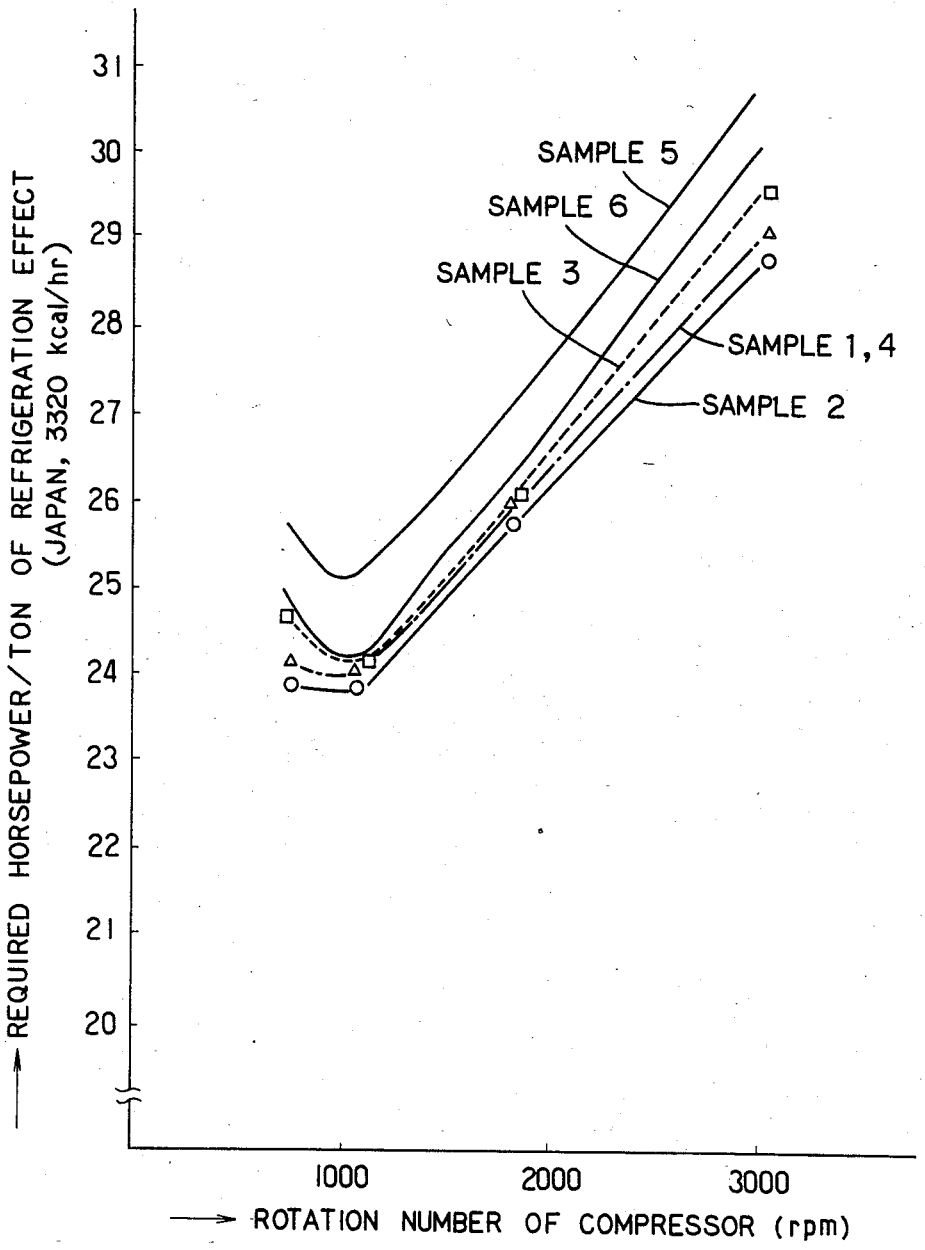
FIG. 21 is a graph showing the merit in respect of power loss of the shoe shown in FIG. 19.

With the samples 1–6 being actually incorporated in a swash-plate type compressor of displacement 150 cc/rev., measurement of the extent of power loss was executed under the condition of sealing the normal amount of the refrigerant gas and lubricating oil in the compressor. The result is shown in a graph of FIG. 21, wherein the following facts can be observed:

1. power loss is larger in the sample 5 which was made by forging than in the sample 6 which was made by cutting a steel ball into half;
2. all of the samples 1–4 made by forging before coated with solid lubricating film were smaller in power loss than those 5 and 6 having no solid lubricating film thereon; and
3. among the samples from 1 through 4 the sample 3 which was applied as a solid lubricating film with (a) molybdenum disulfide ($MoS_2$), (b) boron nitride (BN), graphite (C), polytetrafluoroethylene $[(CF_2—CF_2)_n]$ was the best in respect of the power loss prevention.

Incidentally, the flat side of the shoe is rather favorably located in respect of receiving the supply of lubricating oil and further promoted of oil supply by the formation of the chamfered surface 10*c*, 110*c*, 310*c*, and 310*e* and the gentle convex surface 110*d* and 310*d*, so the formation of the solid lubricating film is by far meaningful to the spherical side which is much more unfavorably located in the oil supply than the flat side. Applying coating of the solid lubricating film only on the spherical side is a permissible way in this sense.

On the flat side of the shoe 410 where it is contacted with the swash-plate 8 the friction is of course generated and the solid lubricating film formed on the surface thereof well functions, just as on the spherical surface, in reducing the friction. However, the flat side is favorably prevented, even when the solid lubricating film is worn to be thinner or next to extinction, from heavy wearing by its gently convex surface and well adjusted surface hardness, so that the controversial seizure between the shoe and the swash-plate can be fully evaded.

What is claimed is:

1. A swash-plate type compressor, comprising:

a housing;

a drive shaft rotatably supported by said housing;

at least one piston slidably fitted in a cylinder bore within said housing, said bore extending parallel to said drive shaft, said piston having at least one concave recess formed therein, the inner surface of said recess having the configuration of part of a sphere;

a swash-plate disposed in said housing and secured to said drive shaft at a predetermined angle of slant thereto for rotation thereby, with a portion of a major surface of said swash-plate extending across at least a portion of said bore;

at least one major surface of said swash-plate comprising an aluminum-silicon alloy having a silicon content in the range of 10% to 25% and a hardness of up to 42 on the Rockwell B scale;

means for introducing a lubricating fluid to said major surface of said swash-plate; and at least one shoe made of hardened steel containing chromium and of a substantially semi-spherical shape having a convex substantially semispherical surface with at least a portion of said convex surface disposed within and in sliding contact with the concave recess of said piston, said shoe having a swash-plate engaging surface with a rounded chamfered annular generally frustoconical peripheral portion and a flat or slightly convex central portion in sliding contact with said major surface of said swash-plate, said central portion having a diameter in the range of 60% to 90% of the diameter of said swash-plate engaging surface, the angle of said frustoconical peripheral portion with respect to the plane of said central portion being no greater than 15 degrees, to positively provide lubricant over said entire swash-plate engaging surface and to maintain the swash-plate engaging surface substantially parallel to said major surface of said swash-plate;

said central portion of said swash-plate engaging surface having a hardness of at least 50 on the Rockwell C scale;

whereby rotation of the shaft causes the swash-plate to rotate so that the central portion of the swash-plate engaging surface of the shoe slides on said major surface of the swash-plate to cause said piston to reciprocate in said bore.

2. A swash-plate type compressor, comprising:

a housing;

a drive shaft rotatably supported by said housing;

at least one piston slidably fitted in a cylinder bore within said housing, said bore extending parallel to said drive shaft, said piston having at least one concave recess formed therein, the inner surface of said recess having the configuration of part of a sphere;

a swash-plate disposed in said housing and secured to said drive shaft at a predetermined angle of slant thereto for rotation thereby, with a portion of a major surface of said swash-plate extending across at least a portion of said bore;

at least one major surface of said swash-plate comprising an aluminum-silicon alloy having a silicon content in the range of 10% to 25%;

means for introducing a lubricating fluid to said major surface of said swash-plate; and at least one shoe made of hardened steel containing chromium and of a substantially semi-spherical shape having a convex substantially semispherical surface with at least a portion of said convex surface disposed within and in sliding contact with the concave recess of said piston, said shoe having a swash-plate engaging surface with a rounded chamfered annular generally frustoconical peripheral portion and a flat or slightly convex central portion in sliding contact with said major surface of said swash-plate, said central portion having a diameter in the range of 60% to 90% of the diameter of said swash-plate engaging surface, the angle of said frustoconical peripheral portion with respect to the plane of said central portion being no greater than 15 degrees, to positively provide lubricant over said entire swash-plate engaging surface and to maintain the swash-plate engaging surface substantially parallel to said major surface of said swash-plate;

said central portion of said swash-plate engaging surface having a hardness of at least 50 on the Rockwell C scale;

whereby rotation of the shaft causes the swash-plate to rotate so that the central portion of the swash-plate engaging surface of the shoe slides on said major surface of the swash-plate to cause said piston to reciprocate in said bore.

3. A compressor in accordance with claim 2, wherein the angle of said chamfered annular generally frustoconical peripheral portion is within the range of 0.5°–10°.

4. A compressor in accordance with claim 2, wherein said swash-plate engaging surface includes a slightly convex central portion having a height within the range of 2–5 μm.

5. A compressor in accordance with claim 2, wherein said chamfered portion includes a first portion formed at an outermost portion thereof at an angle of chamfer within the range of 1°–45° and a second portion formed inside the first portion at an angle of chamfer smaller than that of the first portion.

6. A compressor in accordance with claim 2 used for compressing refrigerant gas in a car air conditioning system, wherein said shoe is lubricated by a mist of a lubrication oil mixed in the circulating refrigerant gas.

7. A compressor in accordance with claim 2, wherein at least the convex semispherical surface of said shoe is coated with a film containing solid lubricant having a thickness not exceeding 10 μm.

8. A compressor in accordance with claim 2, wherein said shoe is a cold-forged, substantially semi-spherical article which includes a film containing solid lubricant and having a thickness not exceeding 10 μm.

9. A compressor in accordance with claim 2, wherein said central portion is a flat surface.

10. A compressor in accordance with claim 2, wherein said central portion is a smooth and slightly convex surface having a large radius of curvature with a height less than 15 μm at its peak located in substantially the center of said swash-plate engaging surface.

11. A compressor in accordance with claim 2, wherein said chamfered portion has at its radially inner end a rounded portion terminating in said central portion.

12. A compressor in accordance with claim 2 wherein the hardness of said central portion is not less than 60 in Rockwell C scale.

* * * * *